United States Patent [19]

Jennings

[11] Patent Number: 4,865,781

[45] Date of Patent: Sep. 12, 1989

[54] METHOD OF CONSTRUCTING A WALL

[75] Inventor: Stephen R. Jennings, Arlington, Tex.

[73] Assignee: Brick-Look, Inc., Euless, Tex.

[21] Appl. No.: 219,729

[22] Filed: Jul. 11, 1988

[51] Int. Cl.[4] ..... B32B 31/06; E04B 1/16; E04B 1/20; E04H 17/14

[52] U.S. Cl. ..... 264/35; 52/743; 256/19; 264/261

[58] Field of Search ..... 264/31-35, 264/DIG. 57, 261, 263; 52/612, 314, 743; 256/19; 405/258, 285, 284, 282, 286, 287

[56] References Cited

U.S. PATENT DOCUMENTS

| | | | |
|---|---|---|---|
| 829,397 | 8/1906 | Gerber . | |
| 983,367 | 2/1911 | Holmberg | 256/19 |
| 984,711 | 2/1911 | Stanley . | |
| 1,135,721 | 4/1915 | Robinson | 264/34 |
| 1,202,298 | 10/1916 | Loser | 264/35 |
| 1,402,906 | 1/1922 | Smith | 264/33 |
| 1,688,523 | 10/1928 | Chown | 264/33 X |
| 1,714,949 | 8/1926 | Collier et al. | 256/19 |
| 2,336,949 | 12/1943 | Mortimer | 264/31 |
| 2,574,711 | 11/1951 | Rose | 256/19 |
| 3,193,255 | 2/1963 | Burdett | 256/19 |
| 3,231,646 | 1/1966 | Conder et al. | 264/35 |
| 3,298,668 | 10/1964 | Schueren | 256/19 |
| 3,512,759 | 5/1968 | Resler | 256/19 |
| 3,554,495 | 1/1971 | Bach et al. | 256/19 |
| 3,698,692 | 10/1972 | Burrows, Jr. | 256/19 |
| 3,844,522 | 10/1974 | Cochran | 249/19 |
| 4,193,584 | 3/1980 | Wieser | 256/19 |
| 4,726,567 | 2/1988 | Greenberg | 256/19 |

*Primary Examiner*—Jan H. Silbaugh
*Assistant Examiner*—Karen D. Kutach
*Attorney, Agent, or Firm*—Charles D. Gunter, Jr.

[57] ABSTRACT

A method of constructing a wall is shown in which vertical columns are erected by stacking a series of precast concrete elements. The elements are spaced-apart by temporary end members to define an upright passage within the column. Concrete is poured within the passage to fill the column interior. After the concrete hardens, the end members are removed to provide oppositely arranged, vertically extending recesses on the column exteriors. The distance between two completed columns is spanned by sliding a precast panel within two of the columns vertical recesses.

6 Claims, 3 Drawing Sheets

METHOD OF CONSTRUCTING A WALL

BACKGROUND OF THE INVENTION

1. Field of the Invention

The present invention relates generally to fence wall construction and particularly to a fence wall constructed by a combination of precast concrete elements which results in a strong and aesthetically pleasing structure.

2. Description of the Prior Art

In the past, fences and retaining walls have primarily been constructed by hand, one piece at a time, through the combination of mortar and brick. The largest single unit of construction was the brick itself. As a result, the process was very slow and labor intensive requiring masons and skilled workers with a a high degree of experience and proficiency. In many cases, the costs of labor exceeded the cost of raw materials used in building the fence.

The present invention provides a prefabricated concrete fence made up of precast units which can be assembled in various combinations to effectively reproduce the appearance of previous brick and stone fences and walls. In the present method, a single semi-skilled worker can assemble fence columns from units that are six to eight times as large as a single brick. Precast panels are used to span the distance between completed columns and are more than one hundred thirty times the size of a single brick.

The precast units can be provided in an infinite number of patterns and color combinations. The end result is a fence wall structure which can be erected at a substantial savings in time and material cost while achieving a permanent, maintenance free, aesthetically pleasing fence or wall.

SUMMARY OF THE INVENTION

In the method of the invention, a wall is constructed utilizing precast concrete elements by first installing a plurality of column foundations at selected, spaced-apart locations. A vertical column is then erected on each column foundation by stacking a series of precast concrete elements. Each element has a pair of lateral edges which are separated by a pair of vertical edges. The lateral edges of adjoining elements are joined by a mortar joint to form a vertical column. The vertical column has an open interior which defines an upright passage within the column and a pair of oppositely arranged, vertically extending recesses which extend along the vertical edges of the elements. Concrete is then poured through the upright passage to fill the open interior and form a completed column. The distance between two completed columns is spanned by sliding a panel within the column vertical recesses, the panel having vertical edges which are adapted to matingly engage the column vertical recesses.

Preferably, a reinforcing member is installed atop selected precast concrete elements within the vertical column. Each reinforcing member is located within the mortar joint between adjoining elements of the vertical column and a portion of the reinforcing member extends transversely across the open interior of the column.

The column vertical recesses can be fashioned by erecting a pair of spaced-apart end members on each column foundation, each end member having an interior surface, an exterior surface, and a length which extends vertically upward from its respective foundation. The interior surface of each end member is surrounded by a thin membrane to facilitate later removal of the end member from the column. The end members are erected plumb and level prior to stacking the precast concrete elements to properly orient the completed column.

Additional objects, features and advantages will be apparent in the written description which follows.

BRIEF DESCRIPTION OF THE DRAWING

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

The method of the invention is applicable to all types of ornamental and utilitarian walls and fences including retaining walls, privacy walls and fences, and the like. The terms "wall" and "fence" are used interchangeably. The wall is first located with reference to building property or lines set out to determine the location of the wall. Using conventional practice, points are located for the foundations of the vertical columns, the column locations being separated by predetermined distances according to, e.g. the property lines, length of the wall, etc. The earth is then excavated to comply with engineering specifications for the vertical columns in accordance with local building codes and manufacturer's requirements. The column foundations can be either round, square, rectangular, or piers. The elevation of each foundation is determined and noted and reinforcement is placed in the excavation and stabilized. Concrete is then poured into the excavation and brought to the predetermined elevation. Preferably, two eight foot reinforcement rods are positioned within the foundation and extend vertically upward therefrom.

A vertical column is then erected on each column foundation by stacking a series of precast concrete elements upon the foundation. Although the precast elements can comprise precast concrete blocks of square or rectangular shape and having open interiors to receive the rebar rods 11, 13, the columns are preferably formed by stacking a series of precast plates (21, 23 in FIG. 1). A typical plate is twenty inches wide, three inches thick and twelve inches high. The plates can be precast in forms or molds in a variety of decorative appearances, such as the brick-like appearance shown in FIG. 1.

Figure 1:
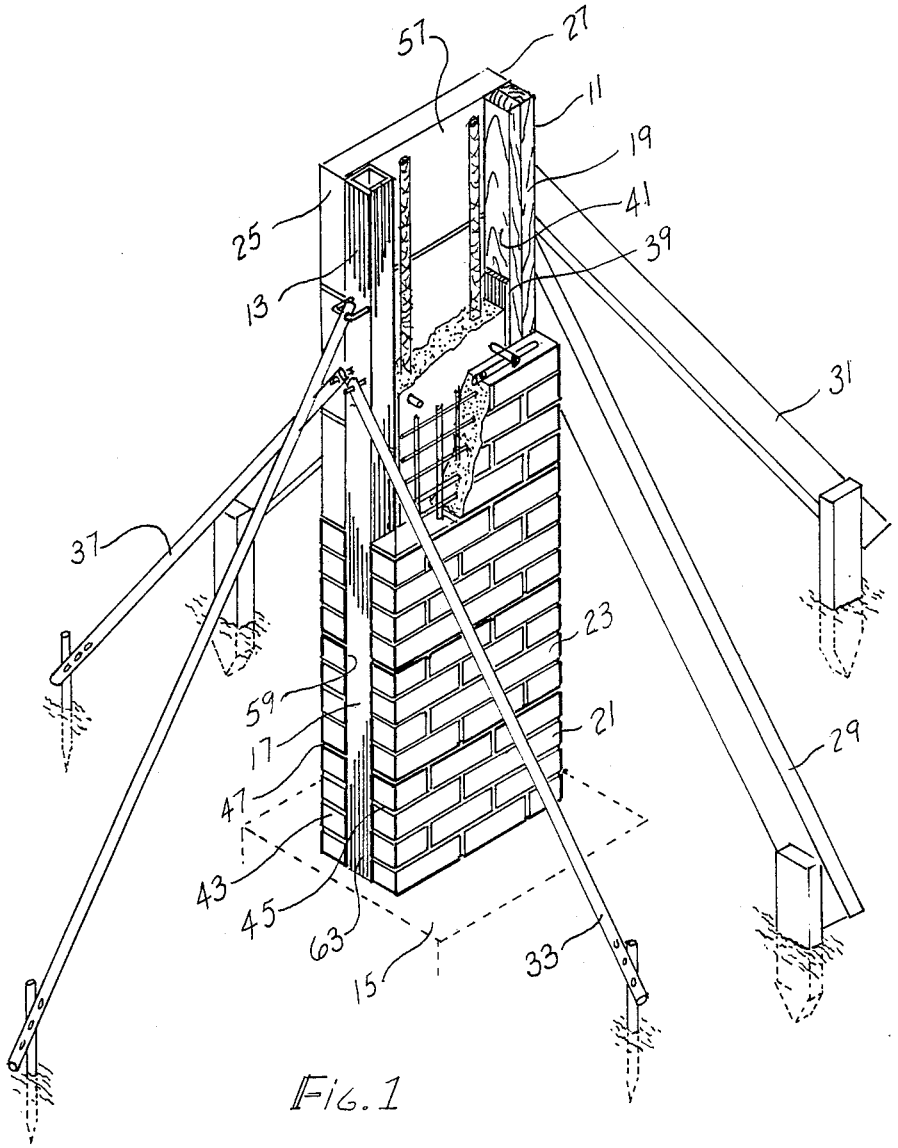
FIG. 1 is an isolated view of a vertical column used in the method of the invention, the column being partly broken away for ease of illustration.
Figure 2:
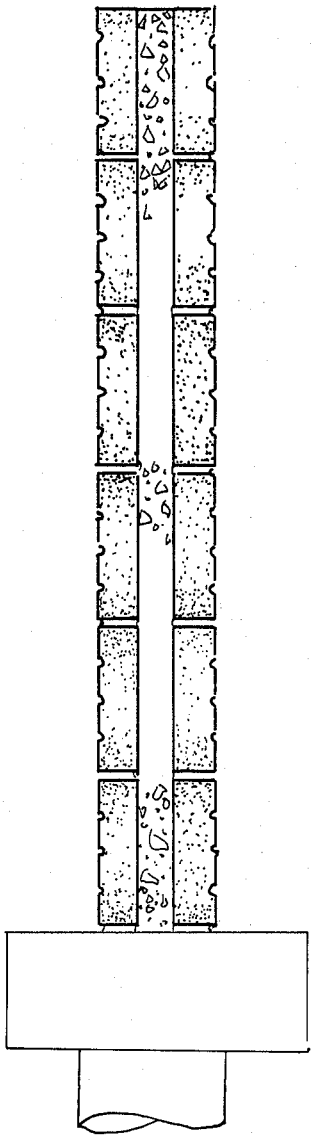
FIG. 2 is a cross-sectional view of a completed vertical column taken along lines II-II in FIG. 6.

In order to orient the plates 21, 23, a pair of end members 17, 19, are erected plumb and level and braced in the exact location to be flush with the panel ends 25, 27. The end members can be posts of steel, wood, plastic, or other available materials. In FIG. 1, end member 19 is made up of a pair of 2×4's which are braced with boards 29, 31. The end member 17 is a piece of channel iron which is braced by metal rods 33, 35, 37. A thin membrane, such as felt strip 39 is placed on the interior surface 41 of each end member 19 to facilitate later removal of the end members.

A thin bed of mortar is then placed on either side of the foundation 15 along lines parallel to the longitudinal axis of the wall. The distance between each line of mortar is determined by the width of the end members 17, 19, plus the width of a mating pair of plates 21, 43. Plates 21, 43 can now be placed on the beds of mortar and brought to level in both the horizontal and vertical planes. A small restraining band, such as a wire band, can then be wrapped around each mating pair of plates 21, 43 and made secure.

Figure 3:
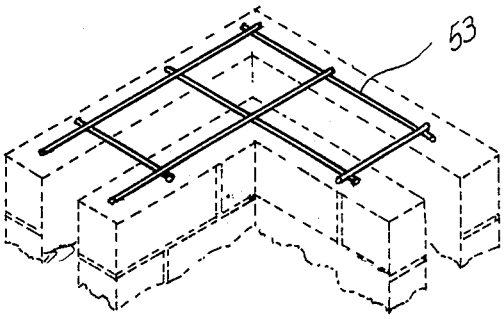
FIG. 3 shows a reinforcing member used in a corner column of the wall, the wall elements being shown in dotted lines.
Figure 4:
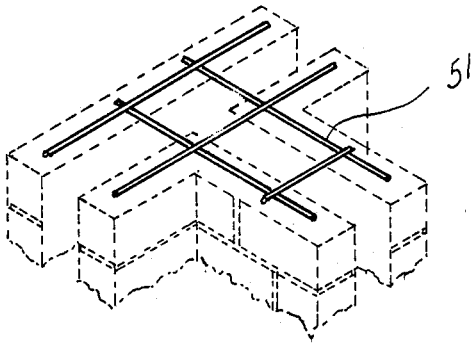
FIG. 4 is a view similar to FIG. 3 showing a reinforcing member used in a column located at a wall intersection.
Figure 5:
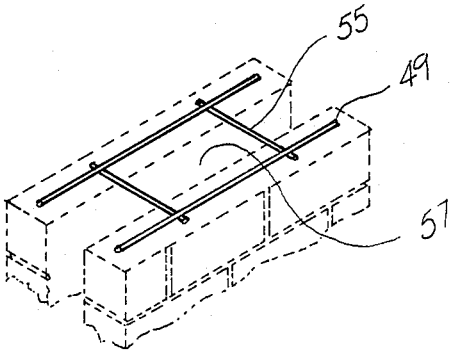
FIG. 5 is a view similar to FIG. 4 showing the reinforcing member used in an intermediate column of the wall.

A bed of mortar can then be placed on the lateral edges 45, 47 of the two plates 21, 43, and a specially designed reinforcing member (49 in FIG. 5) can now be placed across the top edges of the plates 21, 43 and embedded into the wet mortar. As shown in FIGS. 3–5, the reinforcing members 49, 51, 53 are located within the mortar joint between adjoining plates of the vertical column with a portion of each reinforcing member (55 in FIG. 5) extending transversely across the open interior 57 of the column. A new panel (23 in FIG. 1), can now be placed on the mortar joint atop the first panel 21, leveled and secured. This same procedure is repeated until the desired column height is reached. The open interior 57 of the column is then filled from the bottom of column to the top with concrete to create an integral, structural column.

Figure 6:
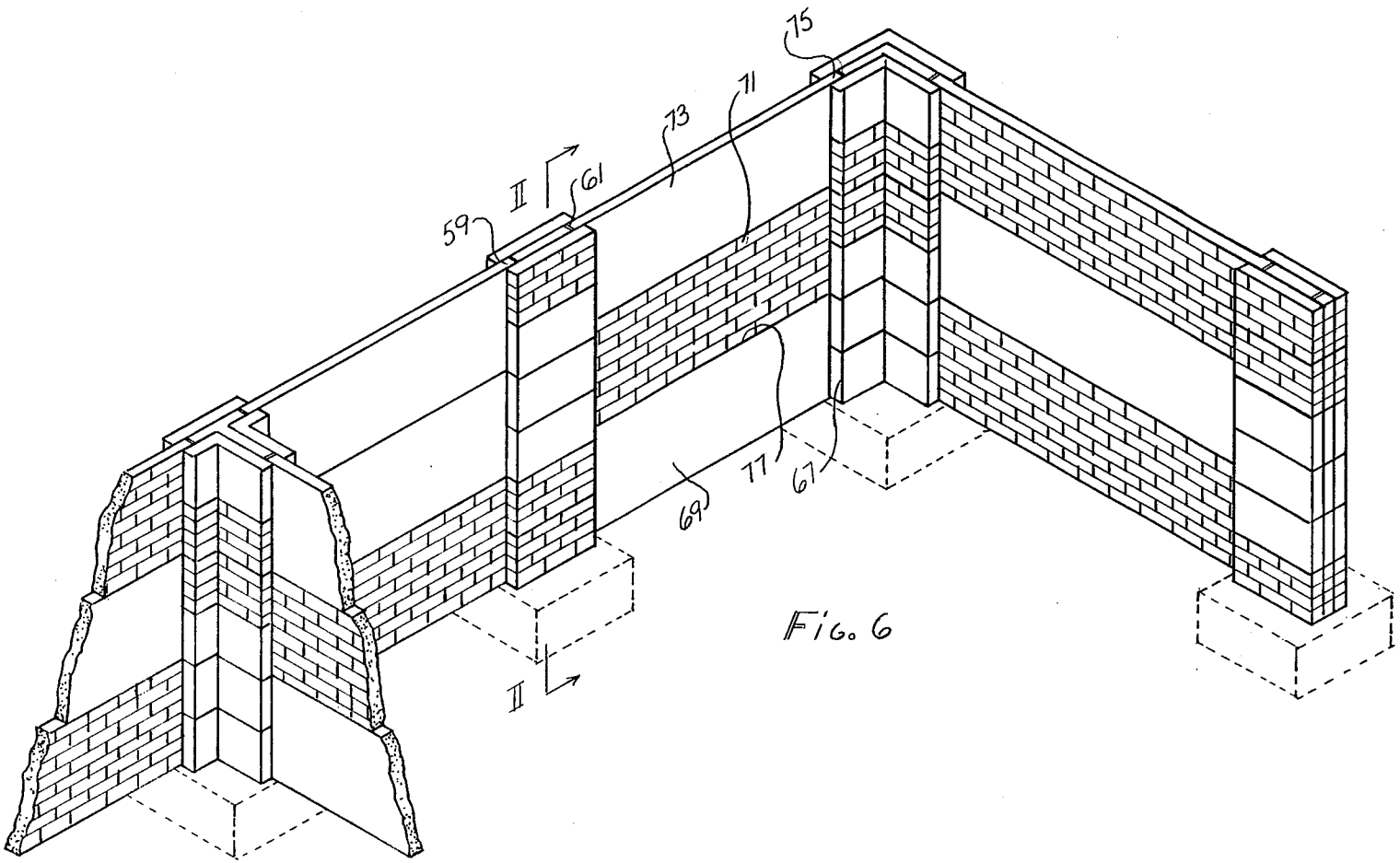
FIG. 6 is a partial, perspective view of the wall constructed utilizing the method of the invention with portions broken away.

When the columns have reached sufficient strength, the retaining bands and end members 17, 19 are removed, thereby creating a pair of oppositely arranged, vertically extending recesses which extend along the vertical edges 63 of the plates. The distance between two completed columns (65, 67, in FIG. 6) is then spanned with a series of horizontal, precast panels 69, 71, 73. The first precast panel 69 is inserted within the mating vertical recesses 61, 75 of columns 65, 67. The panel is brought to level either with shims or mortar. The top edge 77 of the panel is then covered with a bed of mortar and the next succeeding panel 71 is inserted into the vertical recesses 61, 75 and lowered into place. In the event that mortar is not capable of supporting the weight of the panel, shims or spacers can be used to maintain the proper spacing. This procedure is repeated until the desired wall height is achieved. A typical panel is approximately, but not limited to, nine feet in length, two feet in height and three inches thick. The walls and columns can be capped, if desired, with a variety of available precast caps of brick, stone, metal, or plastic.

An invention has been provided with several advantages. The column plates are small enough to be easily handled by one person and are light enough to be erected in the same manner as brick. The intermediate wall or horizontal panels can be easily installed with a small tractor or mechanical lift. The horizontal panels can be removed and replaced if damaged. By using precast units, a fence can be quickly and easily erected with minimum labor expense using semi-skilled workers.

While the invention has been shown in only one of its forms, it is not thus limited but is susceptible to various changes and modifications without departing from the spirit thereof.

What is claimed is:

1. A method of constructing a wall utilizing precast concrete elements, comprising the steps of:

installing a plurality of column foundations at selected, spaced-apart locations;

erecting a pair of removable spaced-apart end members on each column foundation, each end member having an interior surface, an exterior surface, and a length which extends vertically upward from its respective foundation, the interior surface of each end member being surrounded by a thin membrane to facilitate later removal of each end member from each column;

erecting a vertical column on each column foundation by vertically stacking a series of precast concrete elements which overlap the spaced-apart end members on opposite sides of the spaced-apart end members to form a space between the end members and the concrete elements, each element having a pair of lateral edges which are separated by a pair of vertical edges, the lateral edges of adjoining elements being joined by a mortar joint to form the vertical column, the space between the end members and the overlapping elements comprising an open interior which defines a vertical passageway within the vertical column;

pouring concrete through each vertical passageway to fill the open interior of each vertical column;

allowing the concrete to harden within the interior of each column;

removing the spaced-apart end members from each column to leave behind vertically extending recesses which extend along opposing vertical edges of each column;and spanning the distance between two completed columns by sliding a panel within the vertical recesses of two adjacent columns, the panel having vertical edges which are adapted to matingly engage the column vertical recesses.

2. The method of claim 1, further comprising the steps of:

installing a reinforcing member atop selected precast concrete elements within each vertical column, the reinforcing member being located within the mortar joint between adjoining elements of each vertical column, a portion of the reinforcing member extending transversely across the open interior of each column.

3. The method of claim 2, wherein the reinforcing member which is installed atop the precast concrete elements is a H-shaped wire.

4. The method of claim 1, wherein the respective exterior surfaces of the end members on a selected foundation are spaced-apart on the foundation by the desired width of a vertical column, and wherein the vertical edges of the elements making up the column are arranged to extend flush with the exterior surfaces of the end members.

5. The method of claim 4, wherein at least one reinforcing rod is positioned on the foundation between the spaced-apart end members to extend vertically upward within the initially open interior of the vertical column.

6. The method of claim 5, wherein a plurality of panels are used to span the distance between two adjacent columns, the panels being stacked, one upon the other, within the column vertical recesses.

* * * * *